US008215731B2

(12) United States Patent
Drach et al.

(10) Patent No.: US 8,215,731 B2
(45) Date of Patent: Jul. 10, 2012

(54) HANDLE ASSEMBLY FOR A DOMESTIC APPLIANCE

(75) Inventors: Deron M. Drach, Evansville, IN (US); Kendra M. Straub, Haubstadt, IN (US); Julie A. Mann, Haubstadt, IN (US); Frank W. Klitzing, Evansville, IN (US); Garett L. Strandemo, Evansville, IN (US); Eric C. Irwin, Lakewood, CO (US)

(73) Assignee: Whirlpool Corporation, Benton Harbor, MI (US)

( * ) Notice: Subject to any disclaimer, the term of this patent is extended or adjusted under 35 U.S.C. 154(b) by 722 days.

(21) Appl. No.: 12/169,940

(22) Filed: Jul. 9, 2008

(65) Prior Publication Data

US 2010/0005631 A1 Jan. 14, 2010

(51) Int. Cl.
*A47B 96/04* (2006.01)

(52) U.S. Cl. ..... 312/405

(58) Field of Classification Search ..... 312/326–329, 312/405, 244; 16/412, 415, 436, 444; 49/460
See application file for complete search history.

(56) References Cited

U.S. PATENT DOCUMENTS

| | | | | | |
|---|---|---|---|---|---|
| 2,882,549 | A * | 4/1959 | Strauss | 16/412 |
| 3,648,411 | A * | 3/1972 | Saunders et al. | 49/460 |
| 3,766,598 | A * | 10/1973 | Roberts | 16/444 |
| 3,995,349 | A * | 12/1976 | Roberts et al. | 16/412 |
| 4,087,141 | A * | 5/1978 | Roberts | 312/348.6 |
| 4,745,656 | A * | 5/1988 | Revlett | 16/412 |
| 4,926,523 | A * | 5/1990 | Carlson et al. | 16/412 |
| 5,084,940 | A * | 2/1992 | Loffler et al. | 16/412 |
| 5,402,553 | A * | 4/1995 | Goetz et al. | 16/413 |
| 5,740,587 | A * | 4/1998 | Onai et al. | 16/412 |
| 5,797,164 | A * | 8/1998 | Donaghy | 16/412 |
| 5,832,564 | A * | 11/1998 | Shanok | 16/436 |
| 6,430,780 | B1 * | 8/2002 | Kim et al. | 16/412 |
| 6,523,888 | B1 * | 2/2003 | Yan et al. | 296/215 |
| 6,553,629 | B2 * | 4/2003 | Grady et al. | 16/444 |
| 6,609,274 | B2 * | 8/2003 | Christensen et al. | 16/412 |
| 6,871,385 | B2 | 3/2005 | Wing et al. | |
| 7,458,133 | B2 * | 12/2008 | Wing | 16/412 |
| 7,712,590 | B1 * | 5/2010 | Lee | 190/115 |
| 7,870,647 | B2 * | 1/2011 | Steurer | 16/412 |
| 2002/0059698 | A1 * | 5/2002 | Josserand et al. | 16/444 |
| 2003/0093876 | A1 | 5/2003 | Jung et al. | |
| 2004/0094560 | A1 * | 5/2004 | Gose et al. | 220/755 |
| 2006/0200948 | A1 * | 9/2006 | Steurer | 16/412 |
| 2006/0207062 | A1 | 9/2006 | Wing | |
| 2008/0034553 | A1 * | 2/2008 | Wing | 16/412 |

* cited by examiner

*Primary Examiner* — Darnell Jayne
*Assistant Examiner* — Hiwot Tefera
(74) *Attorney, Agent, or Firm* — Kirk W. Goodwin; Diederiks & Whitelaw PLC

(57) ABSTRACT

A handle assembly for mounting to an appliance door includes a main body member having first and second end portions separated by an intermediate portion. First and second plastic end-caps are tightly fit to the first and second end portions via fasteners. The handle assembly is mounted to a front face of the door through interengagment of the fasteners with clips attached to the appliance door. Latch and ramp portions of clips cooperate with the respective fasteners to draw the end-caps into a close locking engagement with the appliance door.

20 Claims, 4 Drawing Sheets

HANDLE ASSEMBLY FOR A DOMESTIC APPLIANCE

BACKGROUND OF THE INVENTION

1. Field of the Invention

The present invention pertains to the art of domestic appliances and, more particularly, to a handle assembly mounting arrangement for an appliance.

2. Description of the Related Art

Conventional handle arrangements for domestic appliances, such as refrigerators, are often formed from multiple pieces, including a handle frame and a handle piece having a gripping portion. Such a handle is typically mounted to a refrigerator cabinet utilizing screws which extend through the handle piece and frame, clamping the handle to a panel of the refrigerator cabinet. Once the handle is in place, a cover is inserted over each screw, with the cover either extending only over the screw or along substantially an entire length of the handle. In general, this handle mounting arrangement is rather difficult to assemble and, often times, results in witness lines that detract from an overall aesthetic appearance of the refrigerator. Additionally, specialized tools are often necessary to remove such a handle from the refrigerator after installation.

There exist numerous other types of refrigerator handle arrangements in the art, such as gas assist handles employed in an attempt to simplify the construction and assembly of the handle. However, regardless of these known arrangements, there still exists a need in the art for an improved mounting arrangement for a refrigerator handle assembly. More specifically, there exists a need for a mounting arrangement that provides a secure attachment, is aesthetically appealing and easily assembled. In addition, there exists a need for a mounting arrangement that can be readily mounted without scratching or otherwise damaging an outer surface of the domestic appliance during construction of the appliance.

SUMMARY OF THE INVENTION

The present invention pertains to a mounting arrangement for an appliance handle assembly. In accordance with a preferred form of the invention, the handle assembly can be selectively mounted to a front face portion of an appliance door such as, for example, a refrigerator. The handle assembly includes a main body member having first and second end portions separated by an intermediate portion, and first and second end-caps which attach to respective first and second end portions. The first and second end-caps are adapted to interengage respective first and second door clips to fix the handle to the appliance door.

In accordance with one aspect of the invention, each end-cap is provided with at least one fastener which secures the end-cap to the main body member and provides a means for attaching the main body member to one of the first and second door clips. More specifically, a head portion of the fastener extending from the end-cap is inserted into a keyhole in the door clip and slid through the keyhole past a latch and into engagement with a ramp portion of the clip, whereby the end-cap being drawn into close contact with the front face of the door upon sliding of the handle relative to the door. The end-cap is preferably made of plastic and includes an edge that flexes and conforms to the main body member as fasteners connecting the main body member to the end-cap are tightened, thereby providing a clean seamless look between the end-cap and the main body member.

Additional objects, features and advantages of the present invention will be more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
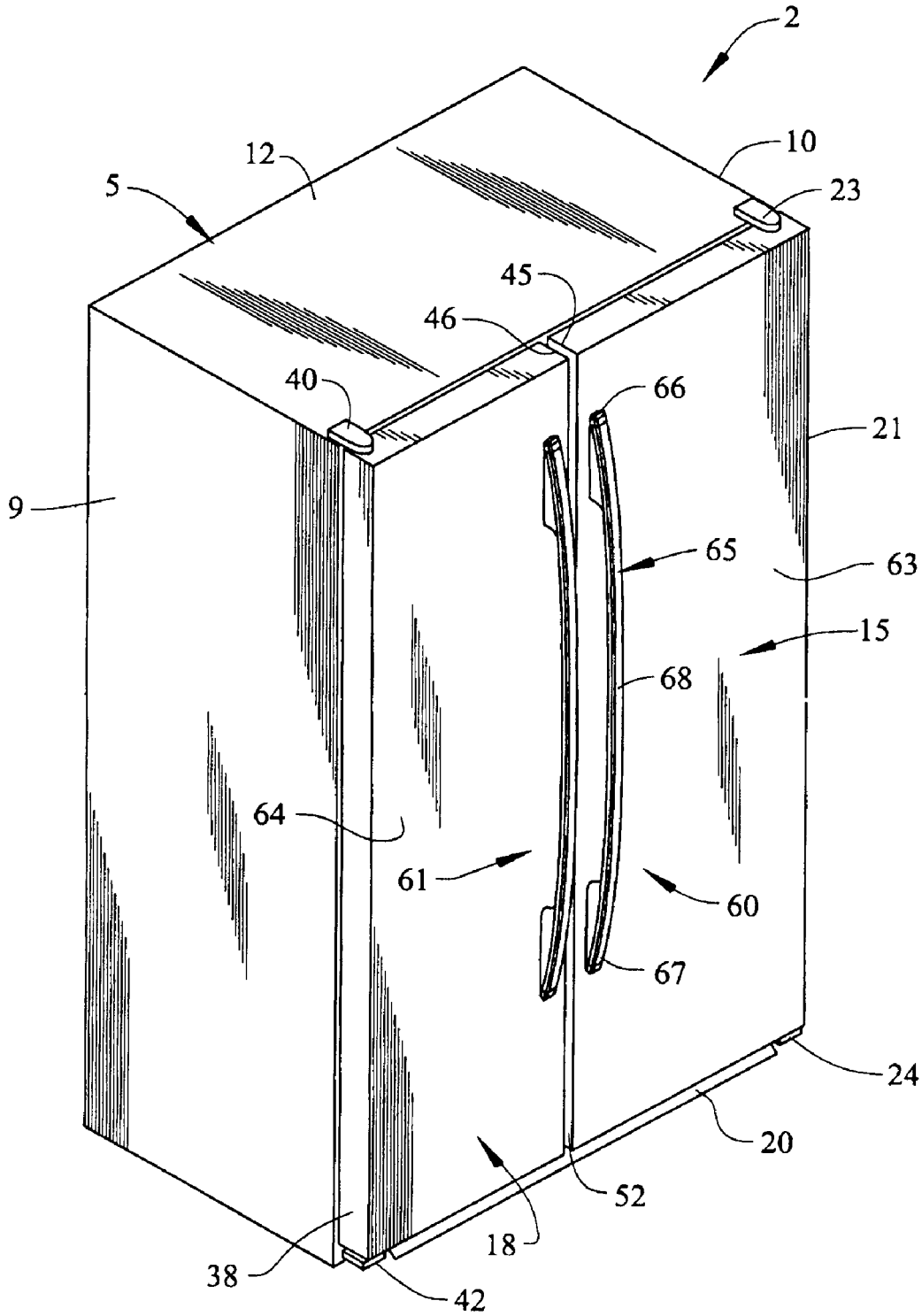
FIG. 1 is an upper left perspective view of a refrigerator incorporating a refrigerator door handle assembly mounted in accordance with the present invention.

With reference to FIG. 1, a domestic appliance constructed in accordance with the present invention is shown in the form of a refrigerator generally indicated at 2. As shown, refrigerator 2 includes a cabinet shell 5 having a pair of opposing side panels 9 and 10 which are interconnected by a top panel 12. Preferably, cabinet shell 5 is formed by bending a single sheet of metal in a manner known in the art. As illustrated, refrigerator 2 constitutes a side-by-side refrigerator having a fresh food compartment door 15 which is arranged laterally juxtaposed a freezer door 18. Extending laterally across cabinet shell 5, below fresh food and freezer doors 15 and 18, is a kick plate 20. In a manner known in the art, fresh food door 15 includes an outer vertical edge portion 21 which is pivotally attached to cabinet shell 5 through an upper hinge 23 and a lower hinge 24.

In a generally similar manner, freezer door 18 includes an outer edge portion 38 which is pivoted at an upper hinge 40 and a lower hinge 42 for movement relative to cabinet shell 5. In a manner also known in the art, fresh food door 15 and freezer door 18 have inner edge portions 45 and 46 respectively which are spaced by a vertical gap 52. As further known, fresh food and freezer doors 15 and 18 conceal corresponding fresh food and freezer compartments (not shown). Aside from the aspects which will be described more filly below, the basic construction and operation of refrigerator 2 is known in the art and does not form part of the present invention. Therefore, this structure will not be discussed further herein. Instead, the present invention is directed to the design and mounting of handle assemblies 60 and 61 for fresh food and freezer doors 15 and 18 respectively.

In accordance with the invention, each handle assembly 60, 61 is mounted to a respective front face portion 63, 64 of fresh food and freezer doors 15 and 18. However, as each handle assembly 60, 61 is preferably identically constructed and mounted, a detailed description will be made with respect to handle assembly 60 with an understanding that handle assembly 61 is correspondingly constructed. Handle assembly 60 includes a main body member 65 preferably formed from extruded metal and having a first end portion 66, a second end portion 67 and an intermediate portion 68. Handle assembly 60 can be mounted to door 15 through a pair of mounting assemblies, one of which is indicated at 70 in FIG. 2. Mounting assembly 70 is preferably arranged at each of first and second end portions 66 and 67 in a manner that will be described more fully below.

Figure 2:
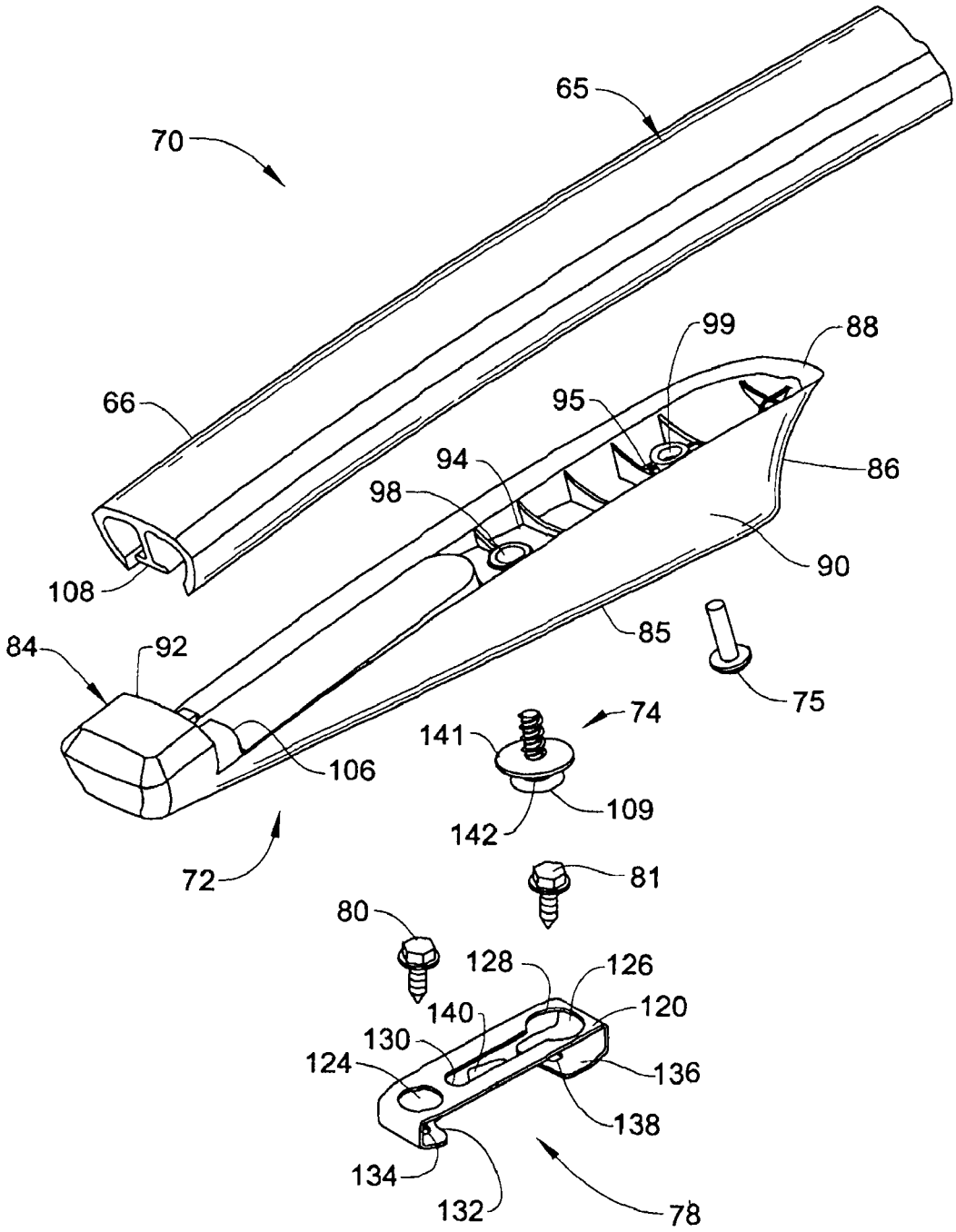
FIG. 2 is a partial exploded view of the handle assembly of FIG. 1.
Figure 3:
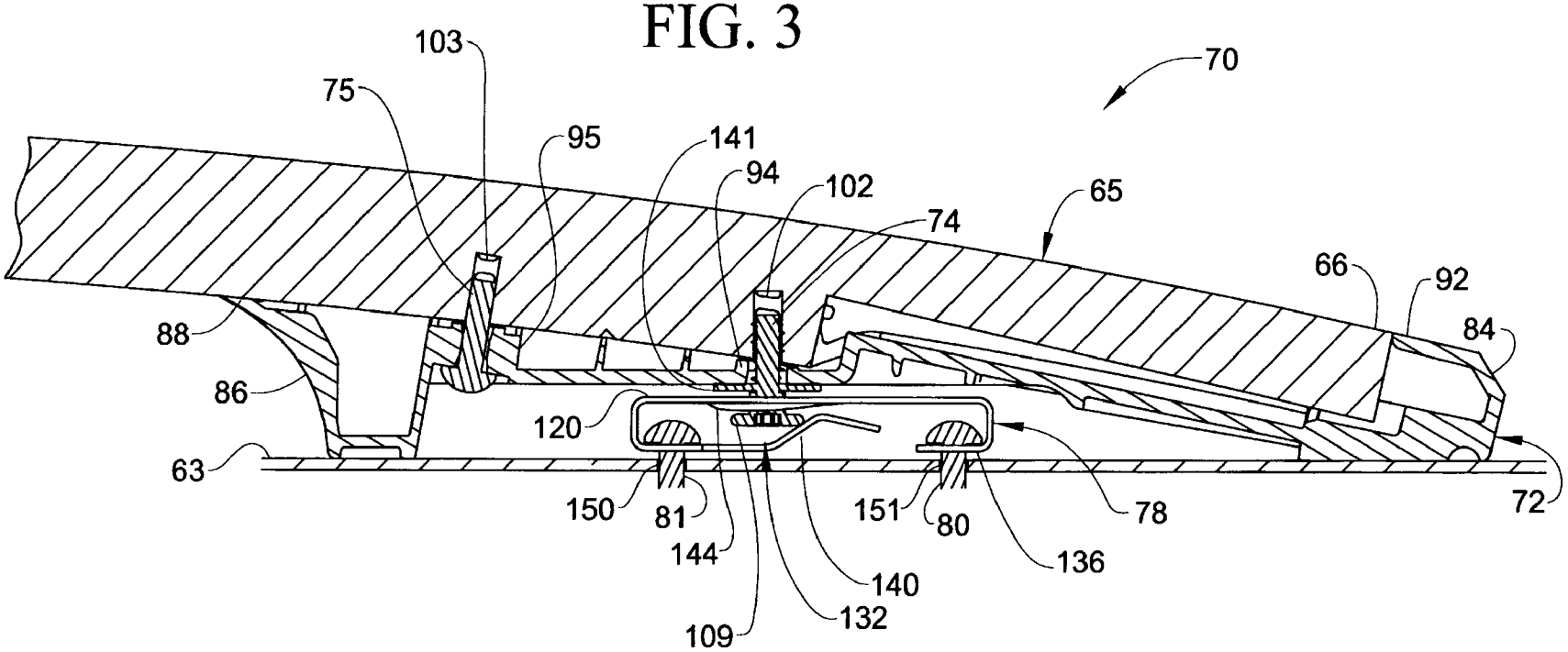
FIG. 3 is a partial, cross-sectional side view of the handle assembly of FIG. 1.
Figure 4:
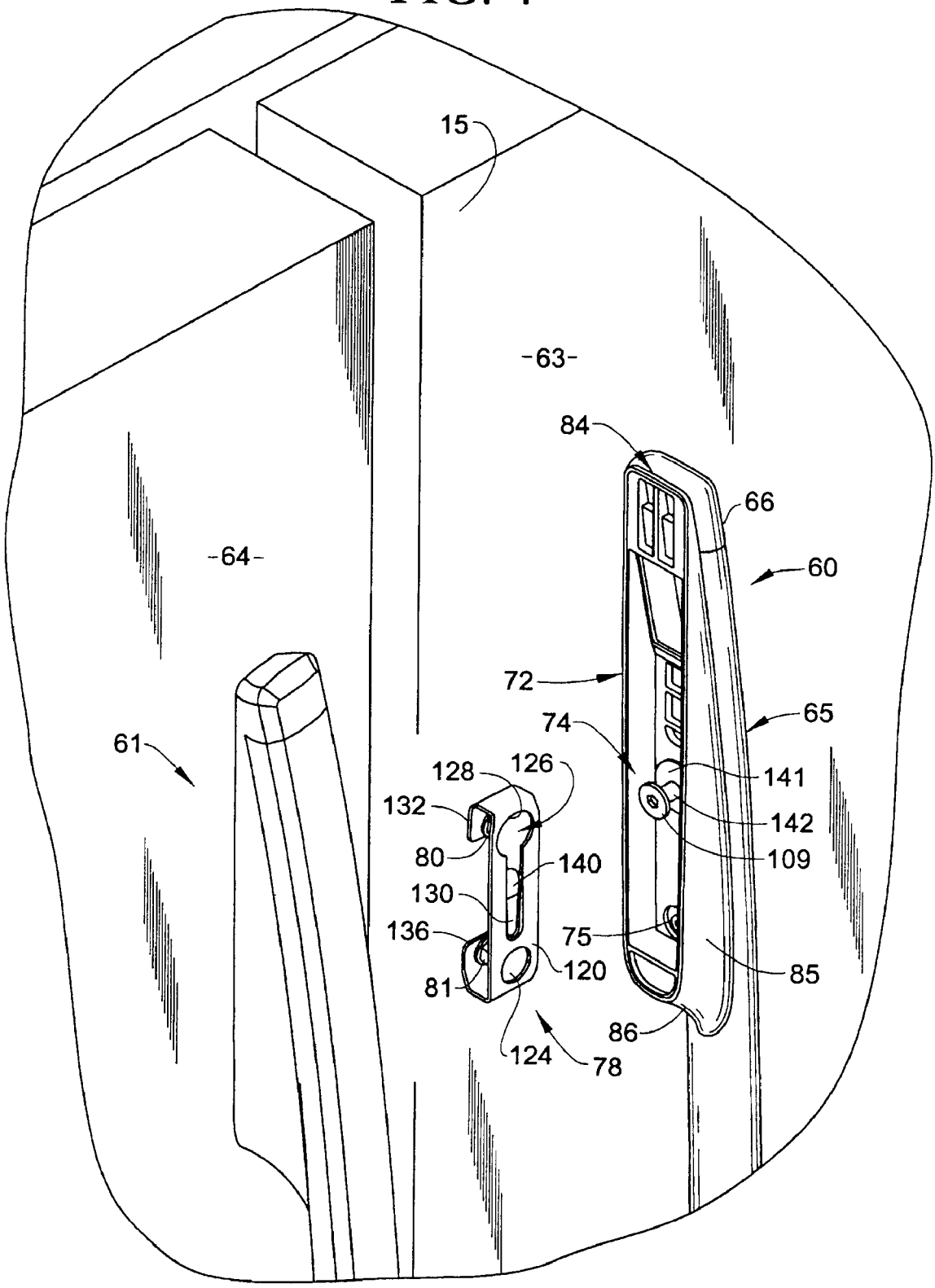
FIG. 4 is an exploded view of the refrigerator handle assembly of FIG. 1 illustrating attachment to a refrigerator door.

Reference will now be made to FIGS. 2-4 in describing mounting assembly 70 constructed in accordance with the present invention. However, at this point it should be realized that, although reference will be made to only first end portion 66 of main body member 65, second end portion 67 includes identical structure so as to receive an identical mounting assembly 70. In any event, mounting assembly 70 includes an end-cap 72 with an engagement fastener 74 and a heel fastener 75, and a door clip 78 with attachment members 80 and 81. End-cap 72 comprises a toe portion 84, a middle portion 85 and a heel portion 86. Additionally, a flexible tapered edge 88 extends outward from a wall 90 located about the periphery of end-cap 72. Toe portion 84 comprises a rim 92 which is adapted to abut a terminal portion (not separately labeled) of first end portion 66 of main body member 65, while the outside surface of rim 92 extends flush with the outside surface of first end portion 66, as shown in FIG. 3. Middle portion 85 has first and second stepped offset portions 94 and 95, which include respective apertures 98 and 99 therein, adapted to receive engagement fastener 74 and heel fastener 75 respectively. End-cap 72 is preferably made from plastic and is adapted to provide a relatively soft non-scratching buffer between handle assembly 60 and front face portion 63 of refrigerator door 15.

Once properly aligned, fasteners 74 and 75 threadingly extend into apertures 98 and 99 and into respective ones of bores 102 and 103 in main body member 65 to secure end-cap 72 to main body member 65. As heel fastener 75 is tightened, flexible tapered edge 88 is brought into tight fitting engagement about first end portion 66 of main body member 65. Furthermore, a receiving flange portion 106 (see FIG. 2), extending from middle portion 85 adjacent toe portion 84, receives a T-shaped extension 108 projecting from main body member 65. This creates a dovetail-type friction-fit arrangement and prevents main body member 65 from twisting relative to end-cap 72.

As best shown in FIG. 4, handle assembly 60 is attached to front face portion 63 of fresh food door 15 through multiple door clips 78. Each door clip 78 is preferably mounted to front face portion 63 of fresh food door 15 and is adapted to engage a head 109 of engagement fastener 74 in a locking manner to secure end-cap 72, and hence main body portion 65, to fresh food door 15. In a preferred embodiment, door clip 78 constitutes a metal spring clip and includes a main section 120 having a fastener access aperture 124 and a keyhole opening 126 for mating with engagement fastener 74 extending from main body portion 65 of handle 60. More specifically, keyhole opening 126 has a bulbous shape including a head portion 128 that is wider than a neck or slot portion 130. A first arm member 132 is folded under main section 120 and includes an attachment aperture 134, while a second arm member 136 is folded under the opposite side of main section 120 and includes an attachment aperture 138. Additionally, second arm member 136 defines a resilient latch 140, which is adapted to engage fastener 74 in a locked position, while being tapered or angled to allow for tool-free detachment of handle assembly 60, as will be discussed more fully below.

Having described a preferred structure of mounting arrangement 70, reference will be made to FIGS. 3-4 in describing a preferred method of attaching handle assembly 60 to fresh food door 15. Initially, receiving flange portion 106 of main body member 65 is slipped into engagement with T-shaped extension 108 of end-cap 72. Fasteners 74 and 75 then attach main body member 65 to end-cap 72 via respective bores 102, 103 and apertures 98, 99. Bores 102 and 103 can be provided with threads that engage fasteners 74 and 75. However, in order to simplify manufacturing, fasteners 74 and 75 are preferably self-tapping. Of course, it should be understood that various other joining methods could be employed, such as drive screws, press-fit fasteners, rivets or the like. When inserted into apertures 98 and 99, a flange 141 of engagement fastener 75 abuts middle portion 85 of end-cap 72 and head 109 is spaced therefrom by a neck portion 142. As fasteners 74 and 75 are tightened, end-cap 72 is brought into contact with main body member 65 and flexible tapered edges 88 of end-cap 72 flex and conform to main body member 65, creating a tight fit with minimized gaps and a seamless look. Next, clip 78 is attached to front face portion 63 of fresh food door 15 via attachment members 80 and 81 inserted through respective apertures 134 and 138 in clip 78 and holes 150 and 151 in fresh food door 15. It should be understood that access aperture 124 and keyhole opening 126 are sized such that a user can access attachment members 80 and 81 to secure the attachment members to fresh food door 15, such as by screwing them into holes 150, 151.

At this point, the assembled handle assembly 60 is ready to be mounted to fresh food door 15. To this end, first end portion 66 is initially aligned with door clip 78. Once so positioned, handle assembly 60 is then shifted or slid relative to fresh food door 15 such that door clip 78 and end-cap 72 interengage. More specifically, head 109 of engagement fastener 74 is inserted into head portion 128 of keyhole opening 126 and the handle and end-cap assembly is shifted downward such that neck portion 142 of engagement fastener 74 slides through the neck portion 130 of keyhole opening 126 until head 109 of engagement fastener 74 engages a ramp portion 144 of clip 78. As head 109 slides against ramp portion 144, end-cap 72 is drawn tight against front face portion 63 of fresh food door 15. Additionally, while sliding through neck portion 130, head 109 pushes past latch 140, causing latch 140 to be deflected from its original position and then snaps over head 109 towards main section 120, thereby providing a bias force against and retaining head 109. At this point, handle assembly 60 is fixed in place upon fresh food door 15. More specifically, in its locked position, head 109 is frictionally held against ramp portion 144, while latch 140 prevents fastener 74 from sliding back through neck portion 130 of keyhole opening 126, as shown in FIG. 3. Simultaneously, a second end portion 67 of handle assembly 60 is attached to fresh food door 15 in an identical manner.

Due to the above construction, the present invention advantageously allows for tool-free removal of handle assembly 60 from fresh food door 15. When a user wishes to remove handle assembly 60 from fresh food door 15, the user may simply apply a forceful upward pressure to handle assembly 60, whereby first arm member 132 will flex and allow head 109 of engagement fastener 74 to slide past latch 140 and out of locking engagement with clip 78. In this context, forceful pressure means pressure that is significantly greater than pressure that would be applied to handle assembly 60 by a user during the course of normal use. It should be readily understood that handle assembly 61 is fixed to and removed from front face 64 of freezer door 18 in the same manner in which handle assembly 60 is fixed to and removed from fresh food door 15. In any case, the structure and flexible nature of clip 78 allows a user to apply pressure to clip 78 through handle assembly 60.

Although described with reference to preferred embodiment of the invention, it should be understood that various changes and/or modifications can be made without departing from the spirit of the invention. For instance, although described with reference to a side-by-side refrigerator, the handle assembly of the invention could be equally employed to other domestic appliances, including top mount, bottom mount or French door style refrigerators, a wall oven, range or the like. In any event, the invention is only intended to be limited in accordance with scope of the following claims.

What is claimed is:

1. A domestic appliance comprising:

a cabinet;

a door pivotally mounted relative to the cabinet, said door having a front face portion;

a handle for shifting the door relative to the cabinet, said handle including:

a main body member having first and second end portions joined by an intermediate portion;

a first end-cap positioned at the first end portion of the main body member and the front face portion of the door;

a first fastener securing the first end-cap to the first end portion;

a second end-cap positioned at the second end portion of the main body member and the front face portion of the door;

a second fastener securing the second end-cap to the second end portion; and first and second spring clips secured at spaced locations upon the front face portion of the door, each of said first and second spring clips including a main section interengaging with a respective one of the first and second fasteners and a resilient arm member extending from the main section and directly engaging with the respective one of the first and second fasteners in a locked position to secure the handle to the door.

2. The domestic appliance according to claim 1, wherein the main section of the first spring clip further comprises an access aperture, a keyhole opening configured to receive the first fastener, and a ramp portion engaging the first fastener; and the main section of the second spring clip further comprises an access aperture, a keyhole opening configured to receive the second fastener, and a ramp portion engaging the second fastener.

3. The domestic appliance according to claim 2, wherein the first and second end portions are drawn against the front face portion of the door through interaction of the first and second fasteners and the respective ramp portions of the first and second spring clips.

4. The domestic appliance according to claim 1, wherein the first and second fasteners are constituted by drive screws positioned in threaded openings located in a bottom wall of respective ones of the first and second end portions of the main body member, wherein the first and second fasteners do not extend through the main body member to a top wall of the main body member and are not visible from the top wall of the main body member.

5. A domestic appliance comprising:

a cabinet;

a door pivotally mounted relative to the cabinet, said door having a front face portion;

a handle fixed to the door for shifting the door relative to the cabinet, said handle including:

a main body member having first and second end portions joined by an intermediate portion, wherein each of said first and second end portions includes outer portions, a central portion interconnecting the outer portions and an extension projecting from the central portion and being spaced from the outer portions;

a first end-cap positioned between the first end portion of the main body member and the front face portion of the door, the first end-cap including a receiving flange beneath which the extension of the first end portion is frictionally received;

a first fastener securing the first end-cap to the first end portion;

a second end-cap positioned between the second end portion of the main body member and the front face portion of the door, the second end-cap including a receiving flange beneath which the extension of the second end portion is frictionally received; and a second fastener securing the second end-cap to the second end portion, wherein the engagement of the extensions of the first and second end portions with the receiving flanges locks said first and second end-caps to the main body member in a dove-tail arrangement.

6. The domestic appliance according to claim 5, wherein each of the first and second end-caps includes a flexible tapered edge that engages a respective one of the first and second end portions of the main body member.

7. The domestic appliance according to claim 6, further comprising first and second heel fasteners which secure the flexible tapered edges of the first and second end-caps into tight fitting engagement with the first and second end portions of the main body member respectively.

8. The domestic appliance according to claim 1, wherein the first and second end-caps are formed from a pliable material and include respective heal and toe portions each serving as a distinct soft interface between the handle and the front face portion of the door.

9. The domestic appliance according to claim 5, further comprising:

first and second door clips secured at spaced locations upon the front face portion of the door, said first and second door clips directly interengaging with respective ones of the first and second fasteners to secure the handle to the door.

10. The domestic appliance according to claim 9, wherein the first door clip constitutes a spring clip including a main section having first and second attachment apertures through which respective first and second attachment members extend to secure the first door clip to the front face portion of the door and a resilient arm member extending from the main section, and the second door clip constitutes a spring clip including first and second attachment apertures through which respective third and fourth attachment members extend to secure the second door clip to the front face portion of the door and a resilient arm member extending from the main section.

11. The domestic appliance according to claim 10, wherein the main section of the first spring clip includes an access aperture and a keyhole opening receiving the first fastener, wherein the resilient arm member of the first spring clip engages the first fastener; and wherein the main section of the second spring clip includes an access aperture and a keyhole opening receiving the second fastener, wherein the resilient arm member of the second spring clip engages the second fastener.

12. A method of removably attaching a handle having outer portions to a front face portion of an appliance door comprising:

securing a first end-cap to a first end portion of the handle by initially inserting a first extension projecting from between the outer portions at the first end portion of the handle beneath a receiving flange on the first end-cap to frictionally retain the first extension under the receiving flange and then interconnecting the first end-cap to the first end portion via a first fastener; and securing a second end-cap to a second end portion of the handle by initially inserting a second extension projecting from between the outer portions at the second end portion of the handle beneath a receiving flange on the second end-cap to frictionally retain the second extension under the receiving flange, wherein the engagement of the first and second extensions of the first and second end portions with the respective receiving flanges locks said first and second end-caps to a main body member in a dove-tail arrangement such that the main body member is prevented from twisting relative to respective first and second end caps, and then interconnecting the second end-cap to the second end portion via a second fastener; and directly interengaging the first and second fasteners with respective first and second clips mounted at spaced locations on the front face portion to mount the handle onto the door.

13. The method of claim 12, wherein frictionally fitting the first extension projecting from the first end portion of the handle under the receiving flange includes slipping the first extension in the form of a T-shaped extension beneath the receiving flange the first end-cap.

14. The method of claim 12, further comprising: sliding the handle and attached first and second end caps relative to the first and second clips after interengaging the first and second fasteners with the first and second clips respectively, until the first and second clips secure the respective first and second fasteners in a locked position.

15. The method of claim 14, further comprising:

inserting a neck on the first fastener into a keyhole on the first clip, and a neck on the second fastener into a keyhole on the second clip; and sliding the first and second fasteners within the keyholes to the locked position.

16. The method of claim 12, further comprising: securing the first and second end-caps to respective first and second end portions of the main body member using corresponding first and second heel screws.

17. The method of claim 12, wherein each of the first and second end-caps is secured to respective ones of the first and second clips through a locking action of the clips.

18. The method of claim 12, further comprising: buffering an interface between the door and the handle by forming each of the first and second end-caps from a soft material.

19. The method of claim 12, further comprising: drawing the first and second end portions against the front face portion of the door through interaction of the first and second fasteners and respective ramp portions of the first and second spring clips.

20. The method of claim 12, further comprising: detaching the handle from the front face portion of the appliance door without the use of a tool by forcefully pulling on the handle along the front face portion of the door to cause the first and second fasteners to deflect first arm members of the first and second clips respectively, and slide out of engagement with the clips.

* * * * *

UNITED STATES PATENT AND TRADEMARK OFFICE

CERTIFICATE OF CORRECTION

PATENT NO. : 8,215,731 B2
APPLICATION NO. : 12/169940
DATED : July 10, 2012
INVENTOR(S) : Deron M. Drach et al.

It is certified that error appears in the above-identified patent and that said Letters Patent is hereby corrected as shown below:

Col. 5, lines 6 - 32, Claim 1: "A domestic appliance comprising: a cabinet; a door pivotally mounted relative to the cabinet, said door having a front face portion; a handle for shifting the door relative to the cabinet, said handle including: a main body member having first and second end portions joined by an intermediate portion; a first end-cap positioned at the first end portion of the main body member and the front face portion of the door; a first fastener securing the first end-cap to the first end portion; a second end-cap positioned at the second end portion of the main body member and the front face portion of the door; a second fastener securing the second end-cap to the second end portion; and first and second spring clips secured at spaced locations upon the front face portion of the door, each of said first and second spring clips including a main section interengaging with a respective one of the first and second fasteners and a resilient arm member extending from the main section and directly engaging with the respective one of the first and second fasteners in a locked position to secure the handle to the door." should be Col. 5, Lines 6 - 32, Claim 1: -- A domestic appliance comprising: a cabinet; a door pivotally mounted relative to the cabinet, said door having a front face portion; a handle for shifting the door relative to the cabinet, said handle including: a main body member having first and second end portions joined by an intermediate portion; a first end-cap positioned between the first end portion of the main body member and the front face portion of the door; a first fastener securing the first end-cap to the first end portion; a second end-cap positioned between the second end portion of the main body member and the front face portion of the door; a second fastener securing the second end-cap to the second end portion; and first and second spring clips secured at spaced locations upon the front face portion of the door, each of said first and second spring clips including a main section interengaging with a respective one of the first and second fasteners and a resilient arm member extending from the main section and directly engaging with the respective one of the first and second fasteners in a locked position to secure the handle to the door. --

Signed and Sealed this
Eleventh Day of September, 2012

David J. Kappos

David J. Kappos
*Director of the United States Patent and Trademark Office*